United States Patent [19]

Yamagata et al.

[11] 4,410,259

[45] Oct. 18, 1983

[54] APPARATUS FOR DEVELOPING LATENT ELECTROSTATIC IMAGE

[75] Inventors: Ryutaro Yamagata, Nishinomiya; Nobuhiko Kozuka, Suita; Hitoshi Nishihama, Hirakata; Shigeo Koyama, Toyonaka; Kazutada Sakai, Takatsuki, all of Japan

[73] Assignee: Mita Industrial Co., Ltd., Japan

[21] Appl. No.: 239,950

[22] Filed: Mar. 3, 1981

[30] Foreign Application Priority Data

| | | | |
|---|---|---|---|
| Mar. 8, 1980 | [JP] | Japan | 55-29629 |
| Jun. 6, 1980 | [JP] | Japan | 55-77998[U] |
| Jun. 17, 1980 | [JP] | Japan | 55-83700[U] |

[51] Int. Cl.[3] ..... G03G 15/08

[52] U.S. Cl. ..... 355/3 DD; 118/656; 118/661

[58] Field of Search ..... 355/3 R, 3 DD; 118/653, 118/656, 657, 658, 661

[56] References Cited

U.S. PATENT DOCUMENTS

| | | | |
|---|---|---|---|
| 3,117,884 | 1/1964 | Greig | 118/657 X |
| 3,863,603 | 2/1975 | Buckley et al. | 118/658 |
| 4,089,297 | 5/1978 | Morita et al. | 355/3 DD X |
| 4,100,884 | 7/1978 | Mochizuki . | |
| 4,119,060 | 10/1978 | Mochizuki et al. | 118/653 |
| 4,120,263 | 10/1978 | Boschet | 118/657 |
| 4,166,691 | 9/1979 | Ebi et al. | 355/11 |
| 4,210,448 | 7/1980 | Forgo | 430/126 |
| 4,227,796 | 10/1980 | Kamp et al. | 118/657 X |
| 4,245,586 | 1/1981 | Palmans et al. | 118/653 X |
| 4,286,543 | 9/1981 | Ohnuma et al. | 118/658 X |
| 4,292,387 | 9/1981 | Kanbe et al. | 118/657 X |
| 4,331,754 | 5/1982 | Stephan | 355/3 DD X |

FOREIGN PATENT DOCUMENTS

| | | | |
|---|---|---|---|
| 2708299 | 9/1977 | Fed. Rep. of Germany . | |
| 2830012 | 1/1979 | Fed. Rep. of Germany | 118/653 |
| 53-3233 | 1/1978 | Japan . | |
| 53-110843 | 9/1978 | Japan . | |
| 53-111737 | 9/1978 | Japan . | |
| 53-135335 | 11/1978 | Japan . | |
| 54-119242 | 9/1979 | Japan | 355/3 DD |
| 55-11226 | 1/1980 | Japan | 355/3 DD |

*Primary Examiner*—Fred L. Braun

*Attorney, Agent, or Firm*—Beveridge, De Grandi & Kline

[57] ABSTRACT

An apparatus for developing a latent electrostatic image, includes a developer holding member having a surface adapted for movement through an endless path and a developer receptacle having an opening formed at a site opposite to a part of the endless path. The receptacle contains a one-component developer consisting only of toner particles capable of retaining an electric charge. The developer in the receptacle is held on the surface of the developer holding member and charged by a charging member. The charged developer is carried to a developing zone by the movement of the surface of the developer holding member and applied to a latent electrostatic image to be developed.

36 Claims, 13 Drawing Figures

Fig. 5-A
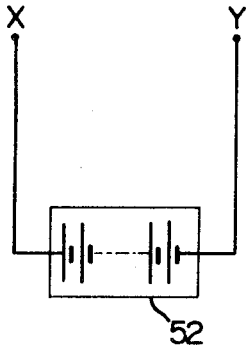
Fig. 5-B
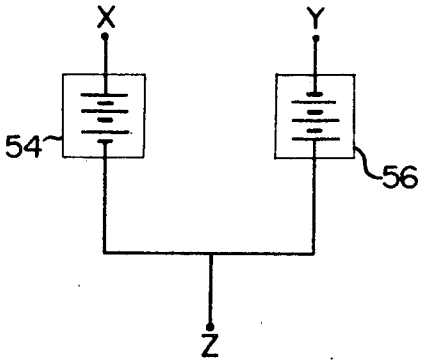
Fig. 5-C
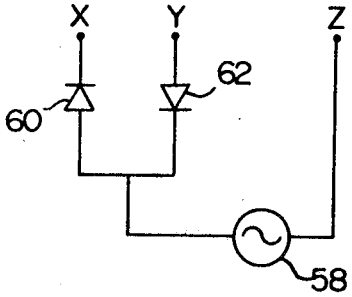
Fig. 5-D
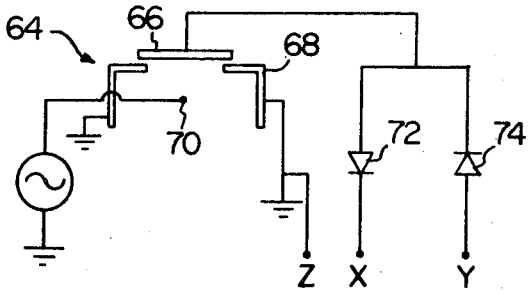
Fig. 5-E
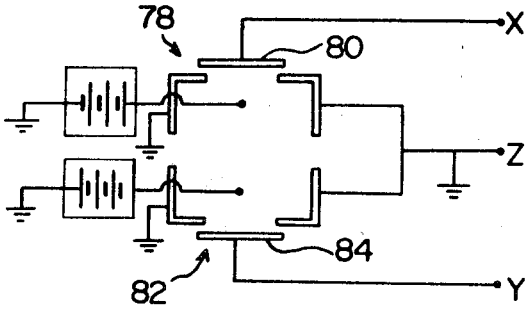

FIG. 8-A
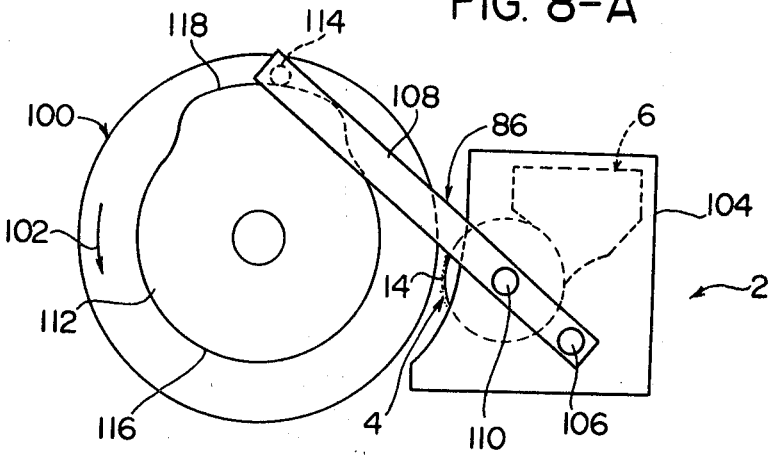
FIG. 8-B
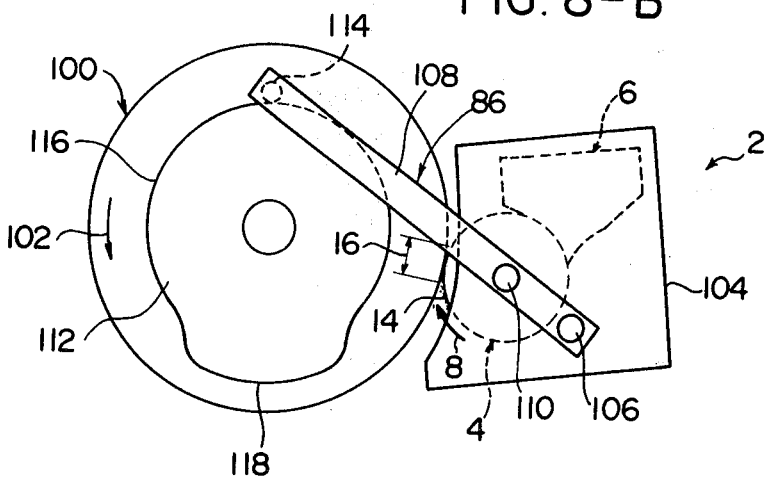

APPARATUS FOR DEVELOPING LATENT ELECTROSTATIC IMAGE

FIELD OF THE INVENTION

This invention relates to a developing apparatus for use with an electrostatic copying machine and the like in applying toner particles to a latent electrostatic image to develop it to a visible image. More specifically, it relates to a latent electrostatic image-developing apparatus of the type involving the use of a one-component developer consisting only of toner particles capable of retaining an electric charge.

DESCRIPTION OF THE PRIOR ART

Developing apparatuses used to apply a toner to a latent electrostatic image to develop it to a visible image in an electrostatic copying machine and the like are roughly classified into those which use a two-component developer consisting of carrier particles and toner particles and those which use a one-component developer consisting only of toner particles. The former, however, encounter problems which are difficult to solve. For example, since in order to carry out good development stably, the ratio between the amounts of the carrier particles and the toner particles should be always fixed, a fresh supply of toner particles must be properly added as the toner particles are consumed during development. These problems have led to the recent tendency toward the widespread acceptance of the latter-type developing apparatuses involving use of a one-component developer.

The latent electrostatic image-developing apparatuses using a one-component developer are classified into those which use (a) a one-component developer consisting only of relatively conductive toner particles, and those which use (b) a one-component developer consisting only of relatively insulating toner particles, according to the properties of the one-component developer used.

Apparatuses and methods using the developer (a) are disclosed, for example, in Japanese Patent Publication Nos. 491/1962, 492/1962 and 20695/1963, Japanese Laid-Open Patent Publication No. 5035/1974, and U.S. Pat. Nos. 2,976,144; 3,909,258; and 4,081,571. As is seen from these prior art references, the use of the developer (a) has the advantage that a special treatment such as the charging of the developer is not required before its contacting with a latent electrostatic image because the developer can be applied as desired to the latent electrostatic image if only the developer is held on the surface of a developer holding member, carried to a developing zone and brought into contact with the latent electrostatic image. Since, however, the toner particles are relatively conductive electrically, it is comparatively difficult to transfer a toner image well to a receptor member when the developer (a) is used in an electrostatic copying machine of the image transfer type.

On the other hand, apparatuses and methods using the developer (b) are disclosed, for example, in Japanese Laid-Open Patent Publication Nos. 3233/1978, 110843/1978, 111737/1978 and 135335/1978. As is seen from these known references, the apparatuses using the developer (b) comprise a developer holding member in the form of a roll or endless belt having a surface adapted for movement through an endless path, a developer receptacle having an opening formed at that site which faces a part of the endless path of movement, and means for charging the developer by a suitable method such as triboelectrical charging. In such an apparatus, a developer stored in the developer receptacle is held on the surface of the developer holding member by a suitable method, and before, or simultaneously with, or after the developer holding operation, the developer is charged to a specified polarity. The charged developer is carried to a developing zone by the movement of the surface of the developer holding member, and applied to a latent electrostatic image, whereby the developer adheres as required to the latent electrostatic image to develop it to a visible image.

The defect associated with the use of the developer (a) can be obviated in using the developer (b) because the toner particles constituting the developer (b) are relatively insulating. However, conventional apparatuses for developing a latent electrostatic image using the developer (b) still have the following problems to be solved.

Firstly, the developer tends to scatter from the developing apparatus to contaminate other constituent elements such as an electrostatic copying machine in which the aforesaid developing apparatus is used. In particular, the developer is liable to dissipate from the upstream edge and/or the downstream edge, viewed in the moving direction of the surface of the developer holding member, of an opening of the developer receptacle which is formed opposite to a part of the endless moving path for the surface of the developer holding member.

As can be easily understood from the above-cited prior art references, the toner particles constituting the developer (b), in most cases, consist generally of non-magnetic particles which cannot be magnetically attracted. When the developer is composed of non-magnetic toner particles, it cannot be magnetically attracted to and held on the surface of the developer holding member by the action of a magnetic field generated by a magnet. It is necessary therefore to hold the developer on the surface of the developer holding mechanically (for example, by mechanical engagement or adhesion between the developer and the surface of the developer holding member) and/or electrically (for example, by adsorption due to Van der Waals force). As is well known to those skilled in the art, however, the power of holding a developer composed of non-magnetic toner particles mechanically and/or electrically is generally weaker than the power of holding a developer composed of magnetic toner particles magnetically by the action of a magnetic field. Accordingly, when the developer composed of non-magnetic toner particles is used, the developer tends to separate relatively easily from the surface of the developer holding member, and this particularly gives rise to the aforesaid problem of developer scattering.

Secondly, repetition of the developing process without particularly removing a residual developer results in a non-uniformly developed image. When the developer held on the surface of the developer holding member is carried to a developing zone and development is performed, only a part of the developer is applied to a latent electrostatic image, and consequently, the developer remains non-uniformly on the surface of the developer holding member after the development. A conventional latent electrostatic image-developing apparatus using the developer (b) as disclosed in the above-cited references is constructed such that in performing the next cycle of development, the residual developer is not particularly removed from the surface of the developer holding member, but a fresh supply of the developer in addition to the residual developer is held onto the surface of the developer holding member. It has been found that in such a conventional latent electrostatic image-developing apparatus, the development becomes non-uniform as the developing cycle is repeated, and development specks form in the developed image (toner image). The cause of this problem seems to be attributed to the following. The developer remaining on the surface of the developer holding member is already in the charged state because it has been charged prior to the previous development. Prior to carrying out the next cycle of development, both a fresh supply of the developer which will be, or is, held on the surface of the developer holding member and the already charged residual developer on the surface of the developer holding member are subjected to a charging step. Consequently, the presence of the charged residual developer tends to cause a non-uniformity in the charged state of the developer to be carried to the developing zone via the charging step. Moreover, when a fresh supply of the developer is to be held onto the surface of the developer holding member which is holding the residual developer remaining non-uniformly, a layer of the developer composed of the residual developer and the fresh developer tends to have a non-uniform thickness. The inventors of the present application theorize that the aforesaid non-uniformity in the charged state of the developer and the aforesaid non-uniformity in the thickness of the developer layer accumulate as the developing cycle is repeated, and as a result, the development becomes non-uniform to cause development specks in the developed image (toner image).

Thirdly, it is difficult to change the charge polarity of the toner particles constituting the developer (b) as desired. If the charge polarity of the toner particles constituting the developer (b) can be changed as desired in the charging step performed prior to the development, a latent electrostatic image can be developed to a positive image or a negative image as desired. For example, a latent electrostatic image having a positive potential or charge can be developed to a positive image if the toner particles constituting the developer are charged to a negative polarity. It can be developed to a negative image if the toner particles are positively charged. However, in such a conventional latent electrostatic image-developing apparatus using the developer (b) as disclosed in the above-cited prior art references, it is extremely difficult, if not impossible, to change the charge polarity of the toner particles as desired, and therefore, a latent electrostatic image cannot be developed easily to a positive image or a negative image as desired.

SUMMARY OF THE INVENTION

It is a first object of this invention to provide a novel and excellent apparatus for developing a latent electrostatic image with a developer of the type (b) described hereinabove, in which the scattering of the developer can be fully prevented even when the developer is composed of non-magnetic toner particles and is therefore held on the surface of a developer holding member not magnetically but mechanically and/or electrically.

A second object of this invention is to provide a novel and excellent apparatus for developing a latent electrostatic image with a developer of the type (b) described hereinabove, which is free from an undesirable phenomenon involving non-uniform development and formation of development specks in the developed image.

A third object of this invention is to provide a novel and excellent apparatus for developing a latent electrostatic image with a developer of the type (b) described hereinabove, in which the charge polarity of toner particles constituting the developer can be very easily changed and therefore, a latent electrostatic image can be easily developed selectively to a positive image or a negative image as desired.

Other objects of the invention will become apparent from a detailed description of the developing apparatus of the invention which follows with reference to the accompanying drawings.

According to the invention, there is provided in regard to the first object a latent electrostatic image-developing apparatus comprising a developer holding member having a surface to be moved through an endless path of movement and a developer receptacle containing a one-component developer consisting only of toner particles capable of retaining an electric charge and having an opening at that site which faces a part of the endless path of movement, said apparatus being adapted to hold the developer on the surface of the developer holding member, charge it, carry the charged developer to a developing zone by the movement of the surface of the developer holding member and apply it to a latent electrostatic image to be developed; characterized in that in the moving direction of the surface of the developer holding member, the downstream edge of the opening of the receptacle is defined by a charging member at least a part of which is formed of an elastic material and whose free end is adapted to be pressed against the surface of the developer holding member, and the upstream edge of said opening is positioned so as to approach or contact the surface of the developer holding member downstream of the topmost part of the endless path of movement.

According to the present invention, there is also provided in regard to the second object a latent electrostatic image-developing apparatus comprising a developer holding member having a surface to be moved through an endless path of movement and a developer receptacle containing a one-component developer consisting only of toner particles capable of retaining an electric charge and having an opening at that site which faces a part of the endless path of movement, said apparatus being adapted to hold the developer on the surface of the developer holding member, charge it, carry the charged developer to a developing zone by the movement of the surface of the developer holding member and apply it to a latent electrostatic image to be developed; characterized in that the developer receptacle has disposed therein a scraping member capable of scraping the surface of the developer holding member in an area within said opening to remove the developer from said surface.

According to the invention, there is further provided in regard to the third object a latent electrostatic image-developing apparatus comprising a developer holding member having a surface to be moved through an endless path of movement and a developer receptacle containing a one-component developer consisting only of toner particles capable of retaining an electric charge and having an opening at that site which faces a part of the endless path of movement, said apparatus being adapted to hold the developer on the surface of the developer holding member, charge it, carry the charged developer to a developing zone by the movement of the surface of the developer holding member and apply it to a latent electrostatic image to be developed; characterized in that said apparatus further comprises a charging member adapted to contact the developer held on the surface of the developer holding member at a position upstream of the developing zone in the moving direction of the surface of the developer holding member and an electrical means for applying a direct-current voltage across the developer holding member and the charging member to charge the developer held on the surface of the developer holding member, said electrical means including a change-over switch mechanism for selectively reversing the polarity of the charging direct-current voltage.

BRIEF DESCRIPTION OF THE DRAWINGS

FIGS. 5-A to 5-E respectively show electric circuits which can be used in combination with the developing apparatus shown in FIG. 4;

FIGS. 8-A and 8-B respectively are simplified side elevations showing that the developer holding member in the developing apparatus shown in FIG. 7 is at an inoperative position and an operative position, respectively.

DETAILED DESCRIPTION OF THE PREFERRED EMBODIMENTS

The invention is described in detail below with reference to the accompanying drawings showing the preferred embodiments of a latent electrostatic image-developing apparatus constructed in accordance with this invention.

General Construction

Figure 1:
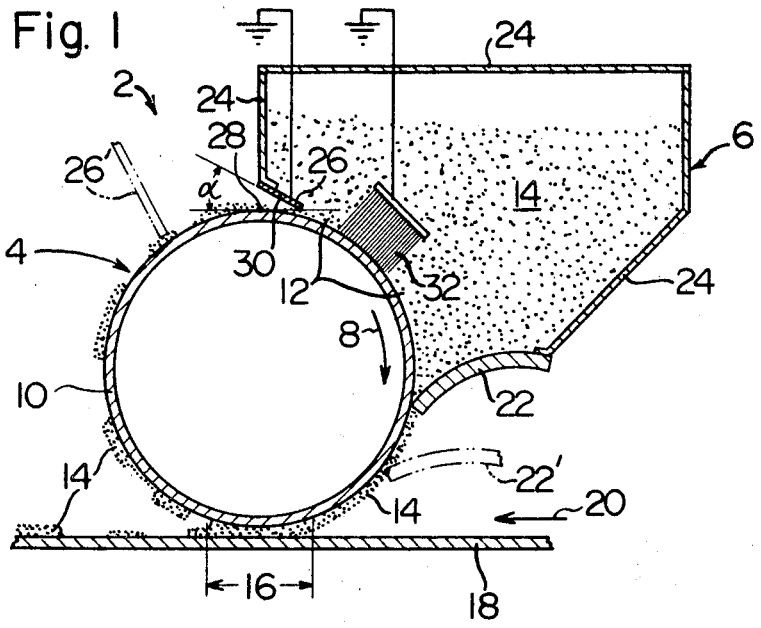
FIG. 1 is a simplified sectional view showing a first embodiment of the developing apparatus constructed in accordance with this invention.
Figure 2:
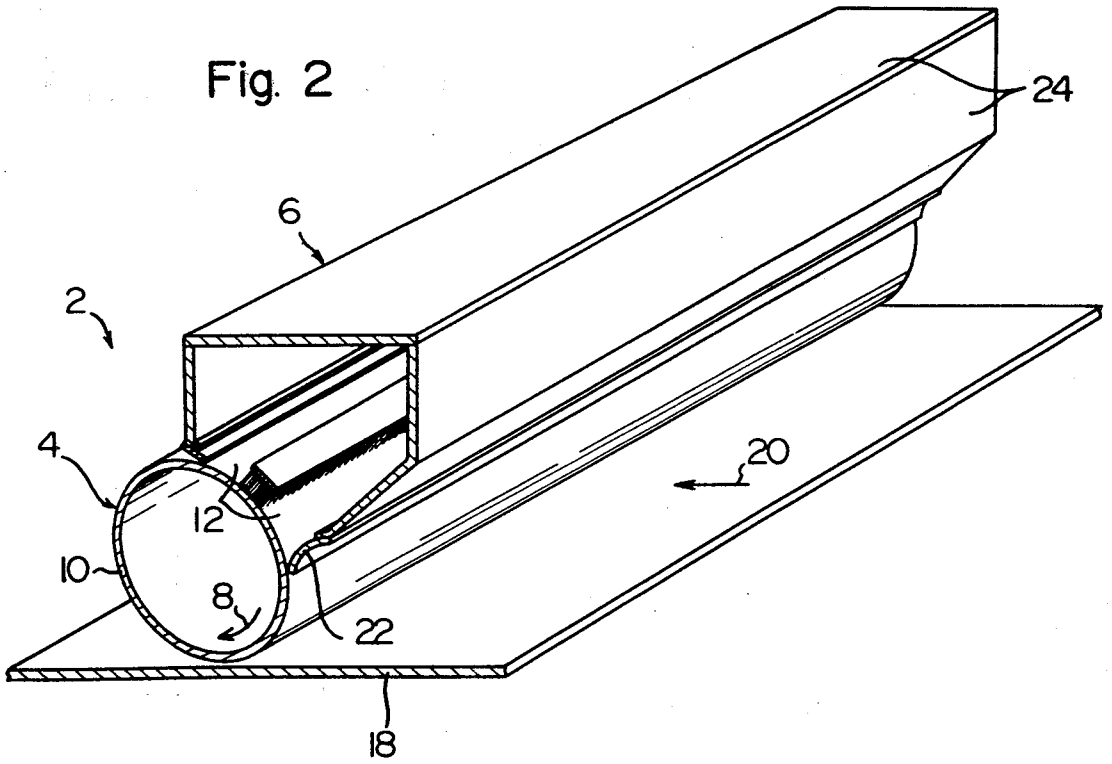
FIG. 2 is a partly broken-away, simplified perspective view of the developing apparatus shown in FIG. 1.

With reference to FIGS. 1 and 2, a latent electrostatic image-developing apparatus shown generally at 2 includes a developer holding member 4 and a developer receptacle 6. The developer holding member 4 may be of any form, such as an endless belt known to those skilled in the art, which has a developer-holding surface capable of being moved through an endless path of movement. In the embodiment shown in the drawings, it is made of a roller 10 rotatable in the direction shown by arrow 8, and therefore, its surface is moved through a circular path defined by the entire peripheral surface of the roller 10 by the rotation of the roller 10 in the direction of arrow 8. The developer receptacle 6 has an opening 12 at that site which faces a part of the moving path of the surface of the developer holding member 4, that is, a part of the peripheral surface of the roller 10 in the illustrated embodiment.

In the illustrated developing apparatus 2, a developer 14 stored in the receptacle 6 contacts the surface of the developer holding member 4 through the opening 12 and is held thereon. It will be electrically charged in the manner to be described in detail below. The developer 14 held on the surface of the developer holding member 4 is carried to a developing zone 16 by the movement of the surface of the developer holding member 4, that is, by the rotation of the roller 10 in the direction of arrow 8 in the illustrated embodiment. In the developing zone 16, a latent electrostatic image-bearing member 18 having a latent electrostatic image formed thereon is continuously moved, for example in the direction shown by an arrow 20. Thus, the charged developer (toner particles) held on the surface of the developer holding member 4 adheres to the surface of the image-bearing member 18 according to the potential or charge of the latent electrostatic image and the latent image is developed to a visible image (toner image).

The individual elements of the developing apparatus 2 are described below in greater detail.

Developer

It is important in the developing apparatus 2 of this invention to use as the developer 14 a one-component developer consisting only of toner particles capable of being charged by a method exemplified hereinbelow, that is, toner particles capable of retaining an electric charge. The toner particles capable of retaining an electric charge are known as relatively insulating toner particles. Preferably, a one-component developer consisting only of toner particles having a specific resistance of at least $10^{12}$ ohms-cm, especially at least $10^{14}$ ohms-cm is used in the developing apparatus 2 of this invention. The toner particles constituting the one-component developer should desirably have a small particle diameter and a high specific surface area so that they can be charged easily and rapidly to saturation. Generally, those having an average particle diameter of 5 to 30 microns, preferably not more than 20 microns, especially preferably not more than 15 microns, are suitable.

Developer Holding Member

The one-component developer 14 consisting only of relatively insulating toner particles is used in the developing apparatus 2 of this invention. The developer 14 is charged by a suitable method such as triboelectric charging before it is carried to the developing zone 16 while being held on the surface of the developer holding member 4. In order to charge the developer 14 sufficiently and easily and to prevent its excessive charging, the specific resistance of at least the surface of the developer holding member 4 is desirably lower than that of the developer 14, as is well known to those skilled in the art. Experiments conducted by the present inventors, on the other hand, show that when the specific resistance of the surface of the developer holding member 4 is decreased to below $10^3$ ohms-cm, the sharpness of the developed image (toner image) is reduced and fogging tends to occur. Preferably, therefore, at least the surface of the developer holding member 4 should have a specific resistance which is lower than that of the developer 14 but is at least $10^3$ ohms-cm.

In many cases, the relatively insulating developer 14 consisting only of toner particles as described above is generally non-magnetic and magnetically non-attractable, as is well known to those skilled in the art. If the developer 14 is magnetic, it can be conveniently attracted to, and held on, the surface of the developer holding member 4 by the action of a magnetic field generated by a magnet disposed within the developer holding member 4. If, however, the developer 14 is non-magnetic, mechanical or electrical means in contrast to magnetic means should be used to hold it on the surface of the developer holding member 4. For accurate holding of the developer 14 on the surface of the developer holding member 4 mechanically or electrically, it is important that a surface layer, at least 100 microns thick, of the developer holding member 4 should have a hardness, measured by the method set forth in JIS (Japanese Industrial Standards) K-2808, of not more than 75 degrees, especially not more than 60 degrees. When the hardness of the surface layer is less than 75 degrees, there is a tendency to excessively decrease the amount of the developer 14 held on the surface of the developer and excessive weakening of its power of holding the developer 14. If the hardness of the surface layer decreases to below 15 degrees, various troubles will occur. For example, when the free end of a charging member 22' for charging the developer 14 is pressed against the developer holding member 4, the surface of the developer holding member 4 is easily damaged. Or it is considerably difficult to control the thickness of a layer of the developer 14 held on the surface of the developer holding member 4. Accordingly, a surface layer, at least 100 microns thick, of the developer holding member 4 is preferably made of a flexible material which possesses excellent elasticity and has a hardness, defined hereinabove, of 15 to 75 degrees, especially 15 to 60 degrees.

For the precise and easy making of the developer holding member 4 meeting the aforesaid requirements for the specific resistance and surface hardness and having a desired shape (e.g., the roll shown in FIGS. 1 and 2, or an endless belt), it is preferred to form a metallic substrate of the desired shape from a suitable metal blank such as aluminum, and then bond a surface layer made of a material meeting the above requirements to the surface of the metallic substrate by, for example, an adhesive. A material containing at least 10% by weight of a silicone rubber, which is flexible and has excellent elasticity, is conveniently used as the surface layer of the developer holding member 4. Since silicone rubbers have a fairly high specific resistance, a resistance controlling agent such as carbon powder or aluminum powder may be incorporated in a required amount in order to adjust the specific resistance of the surface layer as desired.

Investigations of the present inventors also show that the sharpness of the developed image (toner image) can be improved when the surface of the aforesaid surface layer is dotted with high-resistance parts having a higher specific resistance than the surface layer at a distribution degree of 50 to 800 mesh. The high-resistance parts can be formed by applying a silicone rubber or a mixture of it with a suitable resistance controlling agent to the surface of the surface layer of the developer holding member 4 by a screen method known per se. Desirably, the high-resistance parts have a thickness of not more than 500 microns. If the thickness of the high-resistance parts is larger than 500 microns, these parts make it difficult to provide a layer of the developer 14 in uniform thickness on the surface of the developer holding member 4.

As stated hereinabove, the developer holding member 4 may be of any desired shape if its surface capable of holding the developer 14 can be moved through an endless path of movement. From the standpoint of size reduction and ease of manufacture, it is preferably in the form of a roller, particularly the hollow roller 10 illustrated in FIGS. 1 and 2 for weight reduction. When the developer holding member 4 is made of the roller 10, it is preferable to rotate the roller 10 in the direction shown by arrow 8 so that the surface of the developer holding member 4 may be moved in the same direction as the moving direction shown by arrow 20 of the surface of the latent electrostatic image-bearing member 18 in the developing zone 16. If the roller 10 is rotated in a direction reverse to the direction of arrow 8, a "reservoir" of the developer 14 is formed downstream of the developing zone 16 in the moving direction shown by arrow 20 of the image-bearing member 18, and the surface of the latent electrostatic image-bearing member 18 tends to contact the reservoir of the developer 14 after passage through the developing zone 16. Consequently, after the development, the developer 14 drops onto the surface of the image-bearing member 18 and tends to cause "background staining" to the developed image (toner image). Preferably, the roller 10 is rotated at such a rotating speed that the surface of the roller 10 moves at a speed 0.8 to 15 times, especially 1.5 to 5 times, the moving speed of the surface of the image-bearing member 18. It has been experimentally ascertained that if the moving speed of the surface of the roller 10 is smaller than 0.8 time that of the surface of the image-bearing member 18, the sharpness of the developed image (toner image) is reduced, and insufficiency of development is caused, and if the moving speed of the surface of the roller 10 is larger than 15 times that of the surface of the image-bearing member 18, the sharpness of the developed image (toner image) is reduced, background staining occurs, and moreover, the developer 14 scatters in the vicinity of the developing zone 16.

DEVELOPER RECEPTACLE

It is important that in the developer receptacle 6 used in the developing apparatus 2 of the invention, the upstream edge and the downstream edge of the opening 12, viewed in the moving direction shown by arrow 8 of the surface of the developer holding member 4, are constructed as described below in order to prevent the developer 14 from scattering.

First, with reference to the construction of the downstream edge of the opening 12, it is noted that the downstream edge of the opening 12 of the receptacle 6 shown in FIGS. 1 and 2 is defined by a charging member 22 at least a part (the whole in the illustrated embodiment) of which is made of an elastic material and of which free end is adapted to be pressed against the surface of the developer holding member 4. The charging member 22 may be formed integrally with a main portion 24 of the developer receptacle 6. Conventiently, it is formed separately from the main portion 24 which may be made of a suitable plastic or metallic plate and its one end (the right end in FIG. 1) is fixed to the main portion 24. The charging member 22 may be made of any elastic material. Desirably, however, it is made of a material having a lower specific resistance than the surface of the developer holding member 4 in order to perform its important function of acting on the developer 14 held on the surface of the developer holding member 4 and charging it. Spring steel may be cited as an especially suitable material for the charging member 22. Other metallic materials such as phosphor bronze, molybdenum, tungsten and aluminum may also be suitably used instead of spring steel. In making the charging member 22 from spring steel or another metallic material such as phosphor bronze, molybdenum, tungsten and aluminum, it is preferable to heat-treat or anodize it, thereby forming an oxide coating on its surface and increasing its corrosion resistance and abrasion resistance. Instead of the metallic material, a plastic material having a relatively low resistance may be used to form the charging member 22. In this case, it is important to select those plastic materials which have sufficient elasticity and mechanical strength.

The charging member 22 illustrated in FIGS. 1 and 2 contacts the surface of the developer holding member 4 at the site of the opening 12 of the developer receptacle 6 when the surface of the developer holding member 4 is moved in the direction of arrow 8. Thus, the charging member 22 acts on the developer 14 held on the surface and triboelectrically charges it. As is known to those skilled in the art, the charge polarity of the developer 14 induced by the triboelectrical action of the charging member 22 is determined by the relation between a material constituting the developer 14 and a material constituting the charging member 22 in a triboelectrical series. In addition to triboelectrically charging the developer 14, the charging member 22 also performs the function of setting the brush length of the developer 14, namely the function of adjusting the thickness of a layer of the developer 14 carried to the developing zone 16 while being held on the surface of the developer holding member 4 to a desired value. The brush length, or the thickness of the layer of the developer 14 carried to the developing zone 16 while being held on the surface of the developer holding member 4, is adjusted to the desired value by properly adjusting the pressing force of the free end of the charging member 22 against the surface of the developer holding member 4.

In a conventional latent electrostatic image-developing apparatus of the type in which a developer is held on the surface of the developer holding member 4 and is triboelectrically charged before it is carried to a developing zone, there is generally provided separately from the developer receptacle 6 a charging member 22' of which free end is adapted to be pressed against the surface of the developer holding member 4 at a suitable position upstream of the developing zone 16 but downstream of the downstream edge of the opening 12 of the receptacle 16 in the moving direction of the surface of the developer holding member 4, as shown by a two-dot chain line in FIG. 1. Since in such a conventional apparatus for developing latent electrostatic images, the free end of the charging member 22' acts on the developer 14 held on the surface of the developer holding member 4 at a position externally of the developer receptacle 6, the developer 14 is removed from the surface of the developer holding member 4 upstream of the free end of the charging member 22', and scatters. In particular, when the developer 14 is non-magnetic and is therefore held on the surface of the developer holding member 4 not magnetically but mechanically or electrically, the adhesion of the developer 14 to the surface of the developer holding member 4 is relatively weak and the developer 14 comes off from the surface of the developer holding member 4 relatively easily. Accordingly, the aforesaid scattering of the developer gives rise to a serious problem.

In contrast, in the developing apparatus 2 of the invention, the charging member 22 is constructed so as to define the downstream edge of the opening 12 of the receptacle 6 and perform both a charging action and a rubbing action. It will be readily appreciated from FIG. 1 that in this case, the upstream side of the free end of the charging member 22 is located within the developer receptacle 6 and therefore, upstream of the free end of the charging member 22, the removal of the developer 14 from the surface of the developer holding member 4 occurs within the developer receptacle 6. As a result, the developer 14 removed from the surface of the developer holding member 4 by the action of the free end of the charging member 22 is received exactly in the receptacle 6 and is not scattered out of the developer receptacle 6.

Now, the construction of the upstream edge of the opening 12 is described. In a conventional apparatus for developing latent electrostatic images, the upstream edge 26' of the opening 12 in the moving direction of arrow 8 of the surface of the developer holding member 4 is positioned upstream, viewed in the moving direction of the surface of the developer holding member 4, of the topmost part of the moving path for the surface of the developer holding member 4, that is, upstream of a part shown at 28 in the illustrated embodiment, as shown by a two-dot chain line in FIG. 1. Accordingly, a problem of scattering of the developer 14 near the upstream edge of the opening 12 arises in the conventional latent electrostatic image-developing apparatus. In this regard, the upstream edge 26' disposed at the position shown by a two-dot chain line in FIG. 1 needs to closely approach or contact the surface of the developer holding member 4. Otherwise, as will be readily understood, the developer 14 in the receptacle 6 would drop through a space between the upstream edge 26' and the surface of the developer holding member 4 by its own weight and dissipate. When the upstream edge 26' closely approaches or contacts the surface of the developer holding member 4, the upstream side of the upstream edge 26' interferes with the developer 14 which remains on the surface of the developer holding member 4 without adhering to the surface of the latent electrostatic image-bearing member 18 at the time of development in the developing zone 16 and moves together with the surface of the developer holding member 4. This interference tends to cause removing of the developer 14 from the surface of the developer holding member 4. The developer 14 removed from the surface of the developer holding member 4 upstream of the upstream edge 26' falls and dissipates. This undesirable phenomenon is remarkable particularly when the developer 14 is non-magnetic and therefore must be mechanically or electrically held on the surface of the developer holding member 4.

In order to prevent dissipation of the developer 14 accurately near the upstream edge of the opening 12 of the receptacle 6, it is important in the developing apparatus 2 of the invention that as clearly illustrated in FIG. 1, the upstream edge 26, viewed in the moving direction (shown by arrow 8) of the surface of the developer holding member 4, of the opening 12 of the receptacle 6 should approach or contact the surface of the developer holding member 4 at a position downstream of the topmost part of the moving path for the surface of the developer holding member 4, that is, downstream of the part shown at 28 in the illustrated embodiment. If this requirement is met, the upstream edge 26 can be defined by the free end of a suitable member defining the upstream part of the opening 12 of the receptacle 6. Preferably, however, the upstream edge 26 is defined by the free end of a member 30 which inclinedly extends downwardly in a downstream direction with respect to the moving direction of the surface of the developer holding member 4 while forming an angle $\alpha$ of $0° < \alpha < 90°$, particularly $10° \leqq \alpha \leqq 50°$ to a horizontal line passing through the topmost portion 28 of the moving path for the surface of the developer holding member 4, as is clearly shown in FIG. 1.

When the upstream edge 26 of the opening 12 is constructed as described above, any toner particles of the developer 14 which have been removed from the surface of the developer holding member 4 upstream of the upstream edge 26 move downwardly by their own weight along the surface of the developer holding member 4 in a downstream direction with respect to the moving direction shown by arrow 8 of the aforesaid surface, and are finally recovered by the receptacle 6. Hence, the toner particles of the developer 14 removed from the surface of the developer holding member 4 do not come afloat and dissipate in the ambient atmosphere. When the upstream edge 26 is defined by the free end of the member 30 extending inclinedly as stated above, the developer 14 removed from the surface of the developer holding member 4 upstream of the upstream edge 26 of the opening 12 is guided by the undersurface of the member 30 and moves together with the surface of the developer holding member 4 in the direction of arrow 8, and therefore, is recovered in the receptacle 6 more accurately. When the upstream edge 26 is caused to closely approach or contact the surface of the developer holding member 4, the presence of the developer 14 moving together with the surface of the developer holding member 4 imparts a slight elastic depression to the surface of the developer holding member 4 or elastically bends the member 30, whereby the developer 14 gets into the developer receptacle 6.

The member 30 whose free end defines the upstream edge 26 of the opening 12 may be formed integrally with the main portion 24 of the receptacle 6. Or as in the illustrated embodiment, it may be formed of a separate member from the main portion 24 and its one end (i.e., upper end) may be connected to the main portion 24. Preferably, the member 30 is formed of a relatively conductive material having a lower specific resistance than the developer 14, and is grounded either directly or through a suitable bias voltage source (not shown). Such a member 30 can permit leakage of an abnormal charge on the developer 14 remaining on the surface of the developer holding member 4 after the development in the developing zone 16 or on the surface of the developer holding member 4 itself, which abnormal charge may be generated owing to migration of a charge from the surface of the latent electrostatic image-bearing member 18 or the friction between the developer 14 and the surface of the image-bearing member 18.

Modification of the Charging Member

As stated hereinabove, the surface layer of the developer holding member 4 should desirably have a hardness, measured by the method of JIS K-2808, of 15° to 75°, especially 15° to 60°. To meet this requirement, the surface layer is preferably made of a flexible material having excellent elasticity containing at least 10% by weight of a silicone rubber, for example. The material having a hardness in the above-specified range and containing at least 10% by weight of a silicone rubber generally has a fairly high specific resistance of at least $10^{13}$ ohms-cm. Its specific resistance can be reduced by incorporating a resistance controlling agent such as carbon powder or aluminum powder as stated hereinabove. As the amount of the resistance controlling agent increases, the hardness of the material increases correspondingly. Hence, the amount of the resistance controlling agent must be limited in order to maintain the hardness within the above-specified range.

On the other hand, when the specific resistance of the surface layer of the developer holding member 4 is as high as $10^{13}$ ohms-cm or more, some problems tend to arise. They include the following (a) and (b), for example.

(a) It is comparatively difficult to triboelectrically charge the developer 14 (toner particles) fully by the action of the free edge of the charging member 22. The reason is assigned to the following. When the specific resistance of the surface layer of the developer holding member 4 is relatively low and those toner particles which exist on the surface area of the toner particle layer on the surface of the developer holding member 4 are triboelectrically charged, relatively strong electric lines of force are generated which extend from the charged toner particles to the surface of the developer holding member 4 through the toner particle layer. The electric lines of force accelerate charging of the toner particles in the entire toner particle layer. However, when the specific resistance of the surface layer of the developer holding member 4 becomes high, the aforesaid electric lines of force are generally weakened.

(b) The undesirable edge effect is produced on the developed image. This is because if the specific resistance of the surface layer of the developer holding member 4 becomes high, the charge or potential of a latent electrostatic image to be developed weakens electric lines of force generated between the latent electrostatic image and the surface of the developer holding member 4 within the developing zone 16.

An experimental and analytical work of the present inventors, however, has led to the discovery that the aforesaid problems (a) and (b) can be completely avoided by adjusting the thickness of a layer of the developer 14 held on the surface of the developer holding member 4 to a sufficiently small value of, for example, 10 to 50 microns, especially 25 to 35 microns, by the "brush length setting action" of the free end of the charging member 22.

It has been found however that when as shown in FIGS. 1 and 2, the charging member 22 is disposed so as to extend at an angle of about 30° to the normal of the surface of the developer holding member 4 (more specifically, the normal of that position of the surface of the developer holding member 4 against which the free end of the charging member 22 is pressed) upstream in the moving direction shown by arrow 8 of the surface of the developer holding member, the thickness of a layer of the developer 14 held on the surface of the developer holding member 4 cannot always be adjusted to the required small valve accurately and stably even if the pressing force of the free end of the charging member 22 against the surface of the developer holding member 4 is considerably increased.

Figure 3:
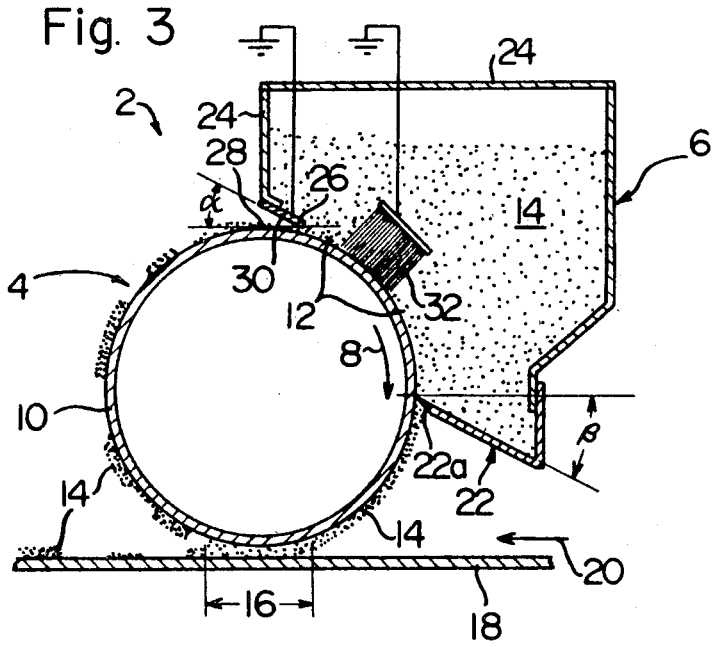
FIG. 3 is a simplified sectional view showing a second embodiment of the developing apparatus constructed in accordance with this invention in which the arrangement of a charging member is modified.

In view of this disadvantage, the arrangement of the charging member 22 has been modified as shown in FIG. 3. In the developing apparatus 2 in FIG. 3, the charging member 22 is disposed such that at least its tip part extends at an angle $\beta$ of 0° to 90°, preferably 10° to 60°, to the normal of the surface of the developer holding member 4 (more specifically, the normal of that position of the surface of the developer holding member 4 against which the free end 22*a* of the charging member 22 is pressed) downstream in the moving direction shown by arrow 8 of the surface of the developer holding member 4, contrary to the charging member 22 shown in FIGS. 1 and 2. By this arrangement, the "brush length setting action" of the free end 22*a* of the charging member 22 is greatly strengthened, and the thickness of the layer of the developer 14 held on the surface of the developer holding member 4 can be adjusted easily and stably to a sufficiently small thickness as required.

In order to fully strengthen the brush length setting action of the free end 22*a* of the charging member 22, the free end 22*a* is preferably in the form of a sharp knife edge as clearly shown in FIG. 3.

Furthermore, in order to render the layer of the developer 14 held on the surface of the developer holding member 4 sufficiently thin by the brush length setting action of the free end 22*a* of the charging member 22, it is important that the free end 22*a* of the charging member 22 should be pressed against the surface of the developer holding member 4 at a pressing force of 80 to 500 g/cm, particularly 100 to 300 g/cm, although the pressing force may be slightly varied depending upon the hardness of the surface of the developer holding member 4, etc.

Scraping Member

The developing apparatus 2 of the invention shown in FIGS. 1 and 2 or 3 further comprises a scraping member 32 which is adapted to scrape the surface of the developer holding member 4 in an area within the opening 12 of the developer receptacle 6 to remove the developer 14 adhering thereto or held thereon.

As is clearly shown in FIGS. 1 and 2 or 3, the scraping member 32 is disposed within the receptacle 6 and is preferably made up of a so-called brush having a number of fine filaments whose free end is adapted to abut against the surface of the developer holding member 4 in an area within the opening 12, preferably at an intermediate part of the opening 12 in the moving direction of the surface of the developer holding member 4. Alternatively, the scraping member 32 may be conveniently made of a blade piece formed of a flexible material whose free end is to abut the surface of the developer holding member 4 at a predetermined position within the opening 12.

The scraping member 32 of the above construction serves to scrape those toner particles of the developer 14, which have not adhered to the surface of the latent electrostatic image-forming member 18 during development in the developing zone 16 but remain on the surface of the developer holding member 4 after development, accurately from the surface of the developer holding member 4. The removed toner particles are mixed with the developer 14 in the developer receptacle 6. Accordingly, in the next cycle of development, the developer 14 in the receptacle 6 adheres to and is held on the surface of the developer holding member 4 quite anew on the downstream side of the scraping member 32 in the moving direction shown by arrow 8 of the surface of the developer holding member 4. The newly held developer 14 is triboelectrically charged by the action of the charging member 22 and carried to the developing zone 16. Thus, in each cycle of development, the developer 14 is held on the surface of the developer holding member 4 quite anew, charged, and then carried to the developing zone 16. As a result, it is possible to prevent the undesirable phenomenon of non-uniform development and formation of development specks in the developed image (toner image) which occurs during repetition of development owing to the remaining of the developer 14 on the surface of the developer holding member 4 after each cycle of development in the developing zone 16.

It may be possible to provide the scraping member 32 also at a position downstream of the developing zone 16 but upstream of the upstream edge 26 of the opening 12 of the developer receptacle 6 viewed in the moving direction shown by arrow 8 of the surface of the developer holding member 4. Such an arrangement, however, causes scattering of the developer 14 which has been removed from the surface of the developer holding member 4 by the action of the scraping member 32. It is important therefore that the scraping member 32 should be disposed within the developer receptacle 6 so as to act on the surface of the developer holding member 4 in an area within the opening 12. This arrangement insures that the developer 14 removed from the surface of the developer holding member 4 by the action of the scraping member 32 is received within the developer receptacle 6 without dissipation.

The brush or blade piece conveniently used as the scraping member 32 may be formed preferably of a suitable elastic material. It is desirable to make it from a relatively conductive material having a lower specific resistance than the developer 14 and to ground it directly or through a suitable bias voltage source (not shown). The use of this type of the scraping member 32 insures that if abnormal charging occurs in the developer 14 remaining on the surface of the developer holding member 4 or in the surface of the developer holding member 4 itself by the causes already mentioned hereinabove with regard to the member 30 defining the upstream edge 26 of the opening 12, the abnormal charge can be leaked to the ground through the scraping member 32. For easy and sufficient leaking of the abnormal charge, it is desirable to make both of the member 30 and the scraping member 32 from a relatively conductive material and ground them.

In order that the free end of the scraping member 32 which may be made of a brush or blade piece may uniformly contact the surface of the developer holding member 4 over an entire width in the axial line direction (i.e., a direction perpendicular to the sheet surface in FIG. 1) and perform a uniform action, both the scraping member 32 and the surface of the developer holding member 4 should be produced and positioned very precisely. In practice, this is extremely difficult, if not impossible. Even if this can be done, the action of the scraping member 32 on the surface of the developer holding member 4 tends to become non-uniform as the development cycle is repeated. In view of this, when the developer holding member 4 is made of roller 10, for example, as in the illustrated embodiment, it is preferable to rotate the roller 10 in the direction of arrow 8 and also to cause it to reciprocate continuously over a predetermined range in the direction of the central axial line of its rotation. By this preferred embodiment, the action of the scraping member 32 on the surface of the developer holding member 4 can be averaged and made sufficiently uniform. Instead of moving the developer holding member 4 reciprocatingly in the axial line direction, it may be possible to move the scraping member 32 reciprocatingly in the direction of the axial line. However, since the reciprocation of the developer holding member 4 in the axial line direction can also effect averaging of the developing action in the developing zone 16 in the axial line direction to achieve very uniform development, it is preferred to move the developer holding member 4 reciprocatingly in the axial line direction if the reciprocation of the developer holding member 4 can be performed by a suitable drive means (not shown) without presenting any particular problem. Of course, if desired, both the developer holding member 4 and the scraping member 32 may be caused to reciprocate separately in the axial line direction in such a manner that their movements do not synchronize.

Embodiment Permitting Easy Changing of the Charge Polarity of the Developer

In the developing apparatus 2 described above and shown in FIGS. 1, 2 and 3, the developer 14 is triboelectrically charged by the charging member 22. The charge polarity of the developer 14 at this time, as is well known, is definitely determined by the relation between a material constituting the developer 14 and a material constituting the charging member 22 in a triboelectrical charging series. Accordingly, to change the charge polarity of the developer 14, the material for the charging member 22 must be changed. It is very difficult, if not impossible, to change the charge polarity of the developer 14 in an apparatus in actual practice.

It is evident that if the charge polarity of the developer 14 can be changed as desired in a latent electrostatic image-developing apparatus of the type involving carrying the developer 14 after it is charged, a latent electrostatic image can be developed to a positive image or a negative image as desired. For example, when a latent electrostatic image formed on the image-forming member 18 has a positive potential or charge in the image areas, and the developer 14 carried to the developing zone 16 has a negative charge, the latent electrostatic image will be developed to a positive image. Conversely, if the developer is charged to a positive polarity, the latent electrostatic image will be developed to a negative image.

Figure 4:
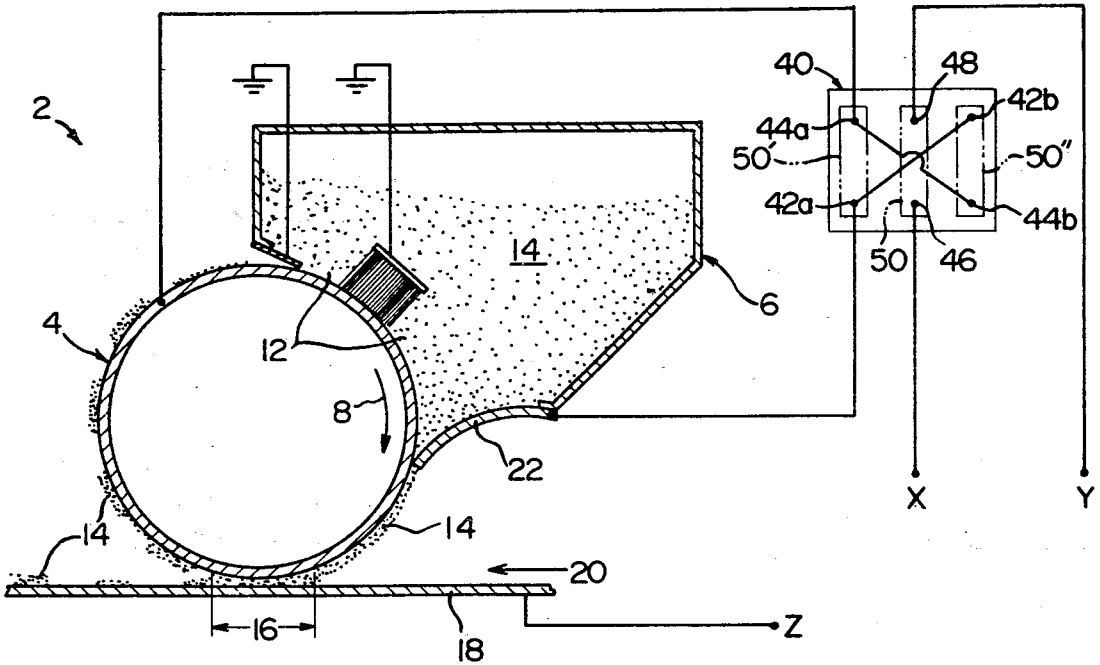
FIG. 4 is a simplified sectional view showing a third embodiment of the developing apparatus which is constructed in accordance with this invention so as to change the charge polarity of a developer easily.

The developing apparatus 2 illustrated in FIG. 4 is adapted for very easy changing of the charge polarity of the developer 14 as desired as a result of modifying the developing apparatus shown in FIGS. 1 and 2 in the following manner.

In the developing apparatus 2 illustrated in FIG. 4, the developer 14 is charged not by the mechanical action of the charging member 22 on the developer 14 but by an electrical means which effects application of a DC voltage across the developer holding member 4 and the charging member 22. Hence, the free end of the charging member 22 needs not always to be pressed against the surface of the developer holding member 4, and it is sufficient that the free end of the charging member 22 electrically contacts the developer 14 held on the surface of the developer holding member 4 upstream of the developing zone 16. The charging member 22 may be disposed separately from the developer receptacle 6. Preferably, however, the charging member 22 is disposed so as to define the downstream edge of the opening 12 of the developer receptacle 6 and the free end of the charging member 22 is pressed elastically against the surface of the developer holding member 4 adapted for movement in the direction of arrow 8 as specifically shown in FIGS. 1 and 2 whereby the charging member 22 also performs the brush length setting action defining the thickness of a layer of the developer 14 held on the surface of the developer holding member 4 and the developer 14 is accurately prevented from dissipating near the downstream edge of the opening 12 of the receptacle 6.

The electrical means for applying a charging DC voltage across the charging member 22 and the developer holding member 4 includes a change-over switch mechanism 40. The change-over switch mechanism 40 is shown to include two contacts **42*a* and 42*b* electrically connected to the charging member 22, two additional contacts 44*a* and 44*b* electrically connected to the developer holding member 4, and two input terminals 46 and 48. The two input terminals 46 and 48 are fixed to a member 50 diagrammatically shown and adapted to be selectively brought to a first operative position shown by a two-dot chain line 50' and a second operative position shown by a two-dot chain line 50'' in FIG. 4 together with the member 50 as an integral unit. Upon the positioning of the member 50 at the first operative position 50', the input terminal 46 is connected to the contact 42 and therefore to the charging member 22, and the input terminal 48, to the contact 44*a* and therefore to the developer holding member 4. When the member 50 is brought to the second operative position 50'', the input terminal 46 is connected to the contact 44*b* and therefore to the developer holding member 4 and the input terminal 48, to the contact 42*b* and therefore to the charging member 22. As shown in FIG. 5-A, a power supply circuit having a DC power supply 52 may be connected between the two input terminals 46 and 48**.

When the member 50 of the change-over switch mechanism 40 is changed from the first operative position 50' over to the second operative position 50'', the polarity of a charging DC voltage applied across the charging member 22 and the developer holding member 4 is reversed to change the charging polarity of the developer 14 held on the surface of the developer holding member 4. Accordingly, by simply operating the change-over switch mechanism 40, a latent electrostatic image on the image-bearing member 18 moved in the direction of arrow 20 can be selectively developed to either a positive image or a negative image as desired.

It is known on the other hand that in a latent electrostatic image-developing apparatus of the type involving carrying the charged developer 14 on the surface of the developer holding member 4 to the developing zone 16 and applying it to a latent electrostatic image, the adhesion of the developer to non-image areas of the latent electrostatic image can be effectively prevented and the latent image can be developed to an image (toner image) free of background staining if a so-called development DC bias voltage is applied across the developer holding member 4 and the image-bearing member 18 bearing a latent electrostatic image during the development process. Application of the aforesaid development bias voltage in addition to the charging DC voltage may be effected, for example, by connecting a power supply circuit having two series-connected DC power supplies 54 and 56 between the two input terminals 46 and 48 of the change-over switch mechanism 40 in place of the power supply circuit shown in FIG. 5-A, and electrically connecting the image-bearing member 18 between the two DC power supplies 54 and 56, as shown in FIG. 5-B. According to this arrangement, while the member 50 of the change-over switch mechanism 40 is at the first operating position 50', a charging DC voltage is applied across the charging member 22 and the developer holding member 4 by the two DC power supplies 54 and 56, and a development DC bias voltage is also applied across the developer holding member 4 and the image-bearing member 18 by the DC power supply 56. Upon changing the member 50 of the change-over switch mechanism 40 from the first operative position 50' over to the second operative position 50'', the polarities of the charging DC voltage and the development DC bias DC voltage are reversed simultaneously, whereby a charging DC voltage is applied across the charging member 22 and the developer holding member 4 by the two DC power supplies 56 and 54 and a development DC bias voltage is applied across the developer holding member 4 and the image-bearing member 18 by the DC power supply 54.

The power supply circuits shown in FIGS. 5-A and 5-B include a DC power supply. Instead of these power supply circuits, there may also be used a power supply circuit shown in FIG. 5-C which contains a forward direction rectifying element 60 and a reverse direction rectifying element 62 together with an AC power supply 58. When the power supply circuit shown in FIG. 5-C is used, the input terminals 46 and 48 of the change-over switch mechanism 40 are connected in parallel to each other to one end of the AC power supply 58 via the forward direction rectifying element 60 and the reverse direction rectifying element 62, respectively. To the other end of the AC power supply 58 is electrically connected the image-bearing member 18. It will be readily appreciated that the use of the power supply circuit shown in FIG. 5-C can produce substantially the same result as the use of the power supply circuit shown in FIG. 5-B.

A DC voltage obtained through the forward direction rectifying element 60 and the reverse direction rectifying element 62 in the power supply circuit shown in FIG. 5-C contains a pulsating current (ripple) component. When the presence of a pulsating current component in the charging DC voltage and the development DC bias voltage causes an undesirable phenomenon, a pulsating current removing element such as a condenser or a coil (not shown) may be provided.

As is well known to those skilled in the art, various corona discharge devices such as a charging corona discharge device used to form a latent electrostatic image, a transfer corona discharge device used to transfer a latent electrostatic image and a charge-eliminating corona discharge device used to remove the residual charge are used frequently in electrostatic copying machines comprising a latent electrostatic image-developing apparatus. In such a case, the DC or AC power supply used in the power supply circuits shown in FIGS. 5-A to 5-C may be omitted, and instead, a part of the discharge current of the corona discharge devices may be collected by a suitable current collecting member to utilize it conveniently as a power supply source for the aforesaid charging DC voltage and the development DC bias voltage.

FIG. 5-D shows one example of a circuit construction for collecting a part of the discharge current of an AC corona discharge device 64 by a current collecting member 66 to utilize it as a power supply for the aforesaid charging DC voltage and the development DC bias voltage. As shown in FIG. 5-D, the current collecting member 66 is disposed opposite to a top opening of a shield case 68 of the AC corona discharge device 64 for collecting a part of the discharge current from a discharge electrode 70 of the AC corona discharge device 64, which intrinsically flows from the shield case to the ground. The current collecting member 66 may be in any suitable form such as a plate or filament, and may be made of a suitable material capable of collecting the discharge current, Preferably, it is made of a material subjected to ozone-resistant treatment, for example a material having a metal oxide coating, in order to avoid adverse effects by ozone contained in the discharge current. For example, the current collecting member 66 can be conveniently made of a metallic material such as tungsten, molybdenum or aluminum having a metal oxide coating formed thereon by anodization, etc. As is the case with the AC power supply 58 in FIG. 5-C, the current collecting member 66 is connected to the input terminal 46 of the change-over switch mechanism 40 shown in FIG. 4 through a forward direction rectifying element 72, and to the input terminal 48 of the change-over switch mechanism 40 shown in FIG. 4 through a reverse direction rectifying element 74. The latent electrostatic image-bearing member 18 (FIG. 4) is grounded, and indirectly connected electrically to the current collecting member 66.

It will be readily appreciated that when the circuit construction shown in FIG. 5-D and described hereinabove is utilized in the developing apparatus 2 shown in FIG. 4, the same result as in the case of using the power supply circuit shown in FIG. 5-C can be obtained without the need for using a special power supply for the charging DC voltage and development DC bias voltage.

FIG. 5-E shows one example of a circuit construction for collecting a part of the discharge current of a positive DC corona discharge device 78 by a current collecting member 80, collecting a part of the discharge current of a negative DC corona discharge device 82 by a current collecting member 84, and utilizing them as power supplies for the aforesaid charging DC voltage and development DC bias voltage. In the circuit construction shown in FIG. 5-E, the current collecting member 80 is connected to the input terminal 46 of the change-over switch mechanism 40 shown in FIG. 4, and the current collecting member 84, to the input terminal 48 of the change-over switch mechanism 40 shown in FIG. 4. The latent electrostatic image-bearing member 18 (FIG. 4) is indirectly connected electrically between the current collecting members 80 and 84.

It is evident that the utilization of the circuit construction shown in FIG. 5-E in the developing apparatus 2 shown in FIG. 4 can produce the same result as the use of the power supply circuit shown in FIG. 5-B without the need for using a special power supply for the charging DC voltage and the development DC bias voltage.

Selective Pressing Mechanism

For accurate and stable performance of good development, it is desirable as stated hereinabove that at least the surface layer of the developer holding member 4 should be made of a relatively flexible material having a hardness, measured by the method of JIS K-2808, of 15° to 75°, especially 15° to 60°, and the surface of the developer holding member 4 should be in press contact with the surface of the latent electrostatic image-bearing member 18. However, if at least the surface layer of the developer holding member 4 is made of a relatively flexible material and the surface of the developer holding member 4 is brought into press contact with the surface of the image-bearing member 18, the following problem generally tends to arise.

When the developing apparatus 2 is in the inoperative state and the surface of the developer holding member 4 is at a stop, the guide surface of a guide plate for pressing the surface of the image-bearing member 18 against the surface of the developer holding member 4 (when the image-bearing member 18 is a sheet-like material such as a copying paper) or the surface of the image-bearing member 18 itself (when the image-bearing member 18 is an electrostatic photographic material disposed on the peripheral surface of a rotary drum or the like) continues to be pressed against a specified part on the surface of the developer holding member 4 within the developing zone 16, and results in localized depression of the specified part of the surface of the developer holding member 4. If at least the surface layer of the developer holding member 4 is made of a material having excellent elasticity, it returns to an initial form when the developing apparatus 2 is operated to move the surface of the developer holding member 4 and release the pressing force acting on it. Some period of time is required, however, for that part of the developer holding member 4 to return to an initial form when the developing apparatus 2 is in the inoperative state and the surface of the developer holding member 4 stops for a relatively extended period of time. It will be readily appreciated that development specks will occur when the developing operation is resumed before the local deformation fully returns to an initial state.

Figure 6:
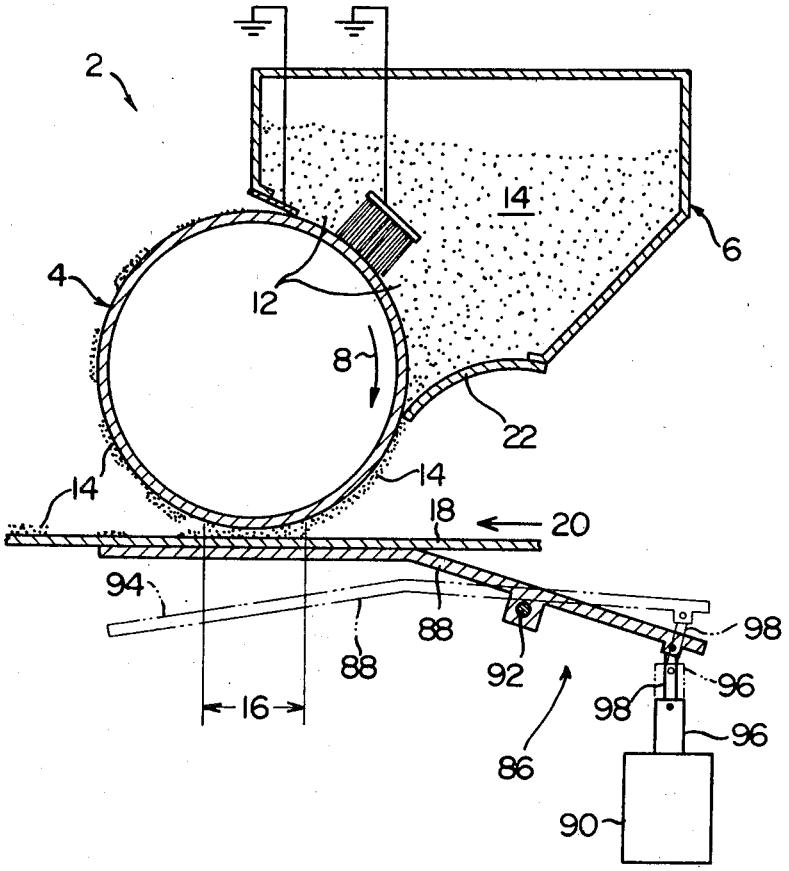
FIG. 6 is a simplified sectional view showing a fourth embodiment of the developing apparatus constructed in accordance with this invention which is provided with a selective pressing mechanism and is suitable for use with a latent electrostatic image-bearing member in sheet form.

The specific embodiment shown in FIG. 6 includes an improvement made in view of the aforesaid fact. The developing apparatus 2 shown in FIG. 6 includes a selective pressing mechanism generally shown at 86 which is selectively actuated as required, and selectively presses the surface of the developer holding member 4 and the surface of the image-bearing member 18.

The selective pressing mechanism 86 applied conveniently when the image-bearing member 18 is a sheet-like material is constructed of a guide plate 88 and an actuator 90. The guide plate 88 is pivotably mounted on a support shaft 92 and selectively brought to an operative position shown by a solid line and an inoperative position shown by a two-dot chain line by the actuator 90. At the operative position, a guide surface 94 defined by the left half of the top surface of the guide plate 88 in FIG. 6 is pressed against the surface of the developer holding member 4, whereas at the inoperative position, the guide surface 94 is moved away from the surface of the developer holding member 4. The actuator 90 may be in any desired form which permits selective positioning of the guide plate 88 either at an operative position or at an inoperative position. In the illustrated embodiment, the actuator 90 is composed of a solenoid whose output terminal 96 is connected to the guide plate 88 through a link 98 having one end pivotably connected to the right end portion of the guide plate 88 in FIG. 6 and the other end pivotably connected to the output terminal 96. Upon energization of the solenoid constituting the actuator 90, the guide plate 88 is brought to the operative position and its guide surface 94 is pressed against the surface of the developer holding member 4. Conversely, when the solenoid constituting the actuator 90 is deenergized, the guide plate 88 is brought to the inoperative position and its guide surface 94 is moved away from the surface of the developer holding member 4.

In the developing apparatus 2 provided with the selective pressing mechanism 86 described above, the guide plate 88 can be held at the operative position by actuating the actuator 90 (energizing the solenoid) only when the developer holding member 4 is rotated in the direction of arrow 8, the image-bearing member 18 is moved in the direction of arrow 20, and the developing operation is actually carried out in the developing zone 16. When the guide plate 88 is at the operative position, the image-bearing member 18 moved between the surface of the developer holding member 4 and the guide surface 94 of the guide plate 88 is pressed against the surface of the developer holding member 4 by the pressing force transmitted from the guide surface 94. As a result, the desired good development can be carried out accurately and stably.

On the other hand, when the developing operation is suspended, namely when the rotation of the developer holding member 4 is stopped and the image-bearing member 18 is not conveyed to the developing zone 16, the guide plate 88 can be brought to the inoperative position by stopping the operation of the actuator 90 (by deenergizing the solenoid). Upon positioning of the guide plate 88 at the inoperative position, the guide surface 94 is moved away from the surface of the developer holding member 4. Accordingly, while the developer holding member 4 is at a stop, the guide surface 94 of the guide plate 88 does not exert a pressing force on a specified part of its surface. As the result, even when the surface layer of the developer holding member 4 is formed of a relatively flexible material, localized depression of a specified part of the surface of the developer holding member 4 and the consequent occurrence of development specks upon resumption of the developing operation can be surely prevented.

In the aforesaid embodiment, the image-bearing member 18 having a latent electrostatic image formed thereon is a sheet-like material. When it is an electrostatic photographic material disposed on the peripheral surface of a rotary drum, selective pressing of the surface of the developer holding member 4 and the surface of the image-bearing member 18 can be performed in the same way as above. In the latter case, it is possible to move the image-bearing member 18 selectively and press its surface selectively against the surface of the developer holding member 4. Since, however, an electrostatic copying machine having a rotary drum generally includes various elements (e.g., an optical system, various charging devices, a cleaning device) disposed around the rotary drum as is known to those skilled in the art, it is preferable to employ such a construction that the developing device 2 is selectively moved to press the surface of the developer holding member 4 selectively against the surface of the image-bearing member 18 (i.e., the peripheral surface of the rotary drum).

Figure 7:
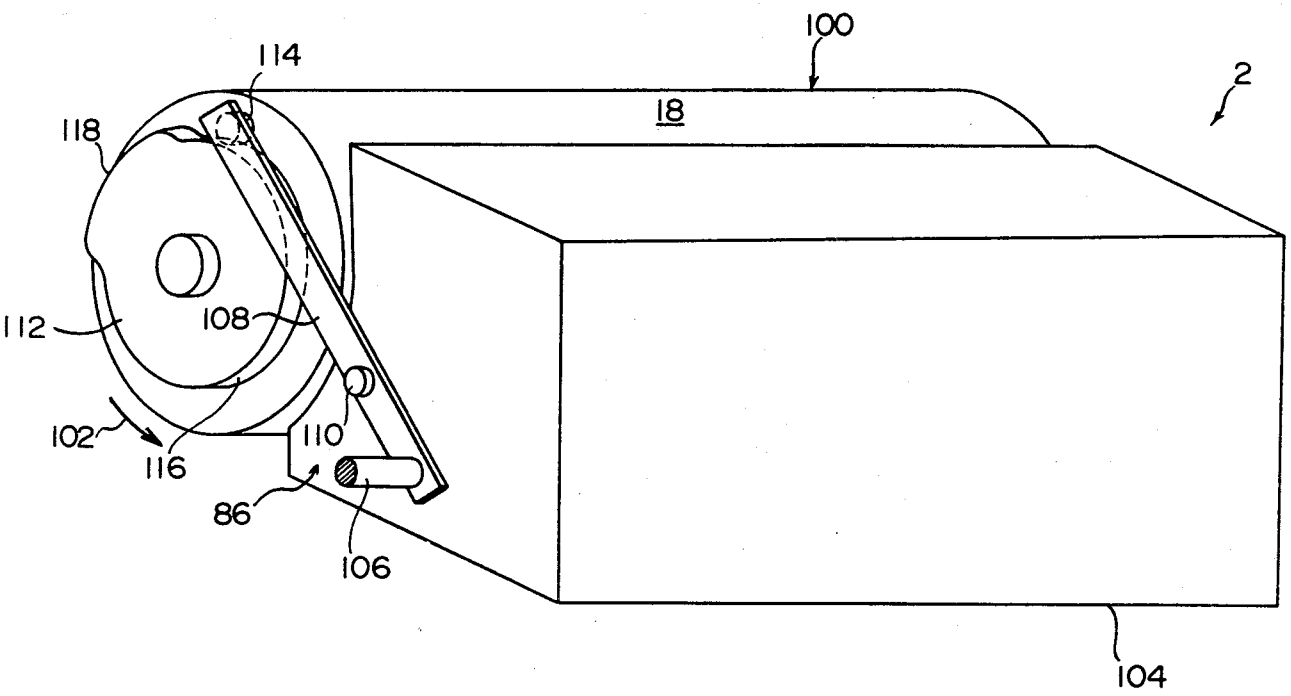
FIG. 7 is a simplified perspective view showing a fifth embodiment of the developing apparatus constructed in accordance with this invention which is provided with a selective pressing mechanism and is suitable for use with a latent electrostatic image-bearing member which is an electrostatic photographic material disposed on the peripheral surface of a rotary drum.

Now, with reference to FIG. 7 and FIGS. 8-A and 8-B, one embodiment of the selective pressing mechanism 86 is described which is applicable when the image-bearing member 18 is an electrostatic photographic material disposed on the peripheral surface of a rotary drum.

In the embodiment shown in FIGS. 7, 8-A and 8-B, a rotary drum 100 is rotatably mounted at a predetermined position, and is rotated in the direction of an arrow 102 by a suitable drive mechanism (not shown) when a copying operation is carried out. An electrophotographic material, i.e. latent electrostatic image-bearing member 18, is disposed on at least a part of the peripheral surface of the rotary drum 100.

The apparatus 2 for developing a latent electrostatic image formed on the image-bearing member 18 includes a housing 104 having disposed therein the developer holding member 4 and the developer receptacle 6. The housing 104 is supported such that it is brought to either one of the inoperative position shown in FIG. 8-A or the operative position shown in FIG. 8-B by a selective pressing mechanism 86 for selectively pressing the surface of the developer holding member 4 against the surface of the image-bearing 18 (i.e., the peripheral surface of the rotary drum 100). A support shaft 106 is disposed at each side portion of the housing 104, and a support lever 108 is pivotably mounted on the support shaft 106. The support shaft 106 and the support lever 108 on the other side portion of the housing 104 are omitted in the drawing. The housing 104 is fixed to the support levers 108, and a shaft 110 of the developer holding member 4 is rotatably supported on the support lever 108. Cams 112 (only one of them is shown) adapted for rotation with the rotary drum 100 are provided on both side surfaces of the rotary drum 100. A follower roller 114 is rotatably supported at the end portion of the support lever 108 for engagement with the peripheral surface of the cam 112. The weights of the housing 104 acting on the support lever 108, the developer holding member 4 and the developer receptacle 6 secured to the housing 104 insure engagement of the follower roller 114 with the peripheral surface of the cam 112. If desired, a suitable spring means may be provided which is adapted for biasing the support lever 108 counterclockwise in FIGS. 8-A and 8-B. The peripheral surface of the cam 112 has a normal portion 116 existing over an angular range of about 270 degrees and a protruding portion existing over an angular range of about 90 degrees in the illustrated embodiment.

In the specific embodiment illustrated in FIGS. 7, 8-A and 8-B, the rotary drum 100 is at a stop at the angular position shown in FIG. 8-A when the electrostatic copying machine equipped with the rotary drum 100 and the developing apparatus 2 is out of operation. In this state, the follower roller 114 supported at the end of the support lever 108 is in engagement with the protruding portion 118 of the peripheral surface of the cam 112, and the support lever 108 and the developing apparatus 2 supported thereon are at the inoperative position shown in FIG. 8-A. At this inoperative position, the surface of the developer holding member 4 is away from the peripheral surface of the rotary drum 100, and therefore, the peripheral surface of the rotary drum 100 does not continuously exert a pressing force on a specified part of the surface of the developer holding member 4 when the developer holding member 4 is at a stop. Accordingly, even when the surface layer of the developer holding member 4 is formed of a relatively flexible material, localized deformation of the specified part of the developer holding member 4 and the consequent occurrence of development specks upon presumption of the developing operation can be surely prevented.

When the electrostatic copying machine is set in operation to rotate the developer holding member 4 of the developing apparatus 2 in the direction of arrow 8 (FIG. 8-B) by the rotation transmitted to the shaft 110 from a suitable drive mechanism (not shown) and to rotate the rotary drum 100 in the direction of arrow 102, the follower roller 114 supported on the end of the support lever 108 comes into engagement with the normal portion 116 of the peripheral surface of the cam 112. As a result, the support lever 108 and the developing apparatus 2 supported on it are pivoted about the support shaft 106 as a center and reaches the operative position shown in FIG. 8-B. At this operative position, the surface of the developer holding member 4 is pressed against the peripheral surface of the rotary drum 100 (therefore, the surface of the image-bearing member 18) in the developing zone 16 (FIG. 8-A) in which the surface of the developer holding member 4 protrudes from an opening formed in the front surface of the housing 104 (i.e., that surface of the housing which faces the rotary drum 100). Thus, a latent electrostatic image formed on the surface of the image-bearing member 18 can be well developed as desired.

In the embodiment shown in FIGS. 7, 8-A and 8-B, the developing apparatus 2 is brought to an operative position or an inoperative position according to the angular position of the rotary drum 100. It is important therefore that when the operation of the electrostatic copying machine provided with the rotary drum 100 and the developing apparatus 2 is to be stopped, the rotary drum 100 should be stopped at an angular position within a predetermined range (at which angular position the follower roller 114 supported on the end of the supporting lever 108 comes into engagement with the peripheral surface of the cam 112), and a portion within a predetermined angular range of the peripheral surface of the rotary drum 100 (i.e., that portion of the drum surface which passes through the developing zone 16 while the follower roller 114 supported on the end of the support lever 108 is in engagement with the normal portion 116 of the peripheral surface of the cam 112) should be used as a zone for forming a latent electrostatic image. In order to make it possible to stop the rotary drum 100 at a desired angular position and use the entire peripheral surface of the rotary drum 100 as a zone for forming a latent electrostatic image irrespective of the aforesaid restrictions on the stopping angular position of the rotary drum 100 and on the zone for forming a latent electrostatic image, a selective pressing mechanism of a suitable form capable of selectively bringing the developing apparatus 2 to an operative position or an inoperative position irrespective of the angular position of the rotary drum 100 may be used instead of the selective pressing mechanism 86 of the above structure.

What we claim is:

1. A latent electrostatic image-developing apparatus comprising a developer holding member in the form of a roller to be rotated, the rotational axial line of said roller extending substantially horizontally, and a developer receptacle containing a one-component developer, which consists only of toner particles capable of retaining an electric charge, and having an opening at that site which faces a part of the surface of said developer holding member, said apparatus being adapted to hold the developer on the surface of the developer holding member, charge the developer, carry the charged developer to a developing zone by the movement of the surface of the developer holding member and apply the charged developer to a latent electrostatic image to be developed; characterized in that the moving direction of the surface of the developer holding member, the downstream edge of the opening of the receptacle is defined by a charging member at least a part of which is formed of an elastic material and of which a free end is adapted to be pressed against the surface of the developer holding member, the upstream edge of said opening is positioned so as to approach or contact the surface of the developer holding member above said rotational axial line and downstream of the topmost part of the surface of the developer holding member, and the upstream edge of the opening of the developer receptacle is defined by the free end of a member which inclinedly extends downwardly at an angle of 10° to 50° to the horizontal line passing through the topmost part of the surface of the developer holding member and downstream in the surface moving direction of the developer holding member.

2. The apparatus of claim 1 wherein the developer has a specific resistance of at least $10^{12}$ ohms-cm, the specific resistance of at least the surface layer of the developer holding member is lower than that of the developer, and the specific resistance of the charging member is equal to, or lower than, that of at least the surface layer of the developer holding member.

3. The apparatus of claim 2 wherein the developer has a specific resistance of at least $10^{14}$ ohms-cm.

4. The apparatus of claim 2 or 3 wherein the specific resistance of at least the surface layer of the developer holding member is lower than that of the developer but is at least $10^3$ ohms-cm.

5. The apparatus of claim 1 wherein the developer holding member includes a metallic substrate and a surface layer mounted thereon, and the surface layer is made of a material having a hardness of 15° to 75° and has a thickness of at least 100 microns.

6. The apparatus of claim 5 wherein the surface layer has a hardness of 15° to 60°.

7. The apparatus of claim 5 or 6 wherein the surface layer is formed of a material containing at least 10% by weight of a silicone rubber.

8. The apparatus of claim 7 wherein high-resistance portions formed of a material having a higher specific resistance than the surface layer are provided in dots on the surface of the surface layer at a distribution degree of 50 mesh to 800 mesh.

9. The apparatus of claim 8 wherein the high-resistance portions have a thickness of not more than 500 microns.

10. The apparatus of claim 1 wherein the charging member is formed of a metallic material having an oxide coating.

11. The apparatus of claim 1 wherein at least the tip portion of the charging member extends at an angle $\beta$ of 0° to 90° to the normal of the surface of the developer holding member downstream in the moving direction of the surface of the developer holding member.

12. The apparatus of claim 11 wherein the angle $\beta$ is 10° to 60°.

13. The apparatus of claim 11 or 12 wherein the free end of the charging member is in the form of a sharp knife.

14. The apparatus of claim 11 or 12 wherein the free end of the charging member is pressed against the surface of the developer holding member at a pressing force of 80 to 500 g/cm.

15. The apparatus of claim 14 wherein the pressing force is 100 to 300 g/cm.

16. The apparatus of claim 11 or 12 wherein the thickness of a layer of the developer held on the surface of the developer holding member is adjusted to 10 to 50 microns by the action of the free end of the charging member.

17. The apparatus of claim 16 wherein the thickness of the developer layer is 25 to 35 microns.

18. The apparatus of claim 1 wherein the developer holding member is rotated so that its surface moves in the same direction as the surface of a latent electrostatic image-bearing member having a latent electrostatic image formed thereon and at a moving speed 0.8 to 15 times as large as that of the surface of the image-bearing member in the developing zone.

19. The apparatus of claim 18 wherein the developer holding member is rotated so that its surface moves at a moving speed 1.5 to 5 times as large as the moving speed of the surface of the image-bearing member.

20. The apparatus of any one of claims 18 to 19 wherein the developer holding member is caused to reciprocate continuously in the direction of its rotational axial line.

21. The apparatus of claim 1 which further includes a selective pressing mechanism for selectively pressing the surface of the developer holding member and the surface of a member having the latent electrostatic image formed thereon in the developing zone.

22. The apparatus of claim 1 wherein a scraping member for removing the developer from the surface of the developer holding member by scraping said surface in an area within the opening is provided in the developer receptacle.

23. The apparatus of claim 1 wherein which further includes an electrical means for applying a direct-current voltage across the charging member and the surface of the developer holding member to charge the developer held on the surface of the developer holding member, said electrical means comprising a change-over switch mechanism capable of selectively reversing the polarity of the direct-current voltage applied across the charging member and the surface of the developer holding member.

24. A latent electrostatic image-developing apparatus comprising a developer holding member having a surface to be moved through an endless path of movement and a developer receptable containing a one-component developer, which consists only of toner particles capable of retaining an electric charge, and having an opening at that site which faces a part of the endless path of movement, said apparatus being adapted to hold the developer on the surface of the developer holding member, charge the developer, carry the charged developer to a developing zone by the movement of the surface of the developer holding member and apply the charged developer to a latent electrostatic image to be developed; characterized in that the developer receptacle has disposed therein a scraping member capable of scraping the surface of the developer holding member in an area within said opening to remove the developer from said surface, said developer has a specific resistance of at least $10^{12}$ ohms-cm, and the scraping member is formed of a material having a lower specific resistance than the developer and is grounded.

25. The apparatus of claim 24 wherein the scraping member is composed of a brush having a number of filaments whose free end is adapted for abutting against the surface of the developer holding member.

26. The apparatus of claim 24 wherein the scraping member is composed of a blade piece formed of a flexible material and having a free end adapted to abut against the surface of the developer holding member.

27. The apparatus of claim 24 25 or 26 wherein the developer holding member is composed of a roller adapted to be rotated and continuously reciprocate in the direction of its rotational axial line.

28. A latent electrostatic image-developing apparatus comprising a developer holding member having a surface to be moved through an endless path of movement and a developer receptacle containing a one-component developer, which consists only of toner particles capable of retaining an electric charge, and having an opening at that site which faces a part of the endless path of movement, said apparatus being adapted to hold the developer on the surface of the developer holding member, charge the developer, carry the charged developer to a developing zone by the movement of the surface of the developer holding member and apply the charged developer to a latent electrostatic image to be developed; characterized in that said apparatus further comprises a charging member adapted to contact the developer held on the surface of the developer holding member at a position upstream of the developing zone in the moving direction of the surface of the developer holding member and power means for applying a direct-current voltage across the developer holding member and the charging member to charge the developer held on the surface of the developer holding member, said power means including a current collecting member for collecting a portion of discharge current from a corona discharge device.

29. The apparatus of claim 28 further comprising a change-over switch mechanism for selectively reversing the polarity of said direct-current voltage.

30. A latent electrostatic image-developing apparatus comprising a developer holding member having a surface to be moved through an endless path of movement, a developer receptacle containing a one-component developer, which consists only of toner particles capable of retaining an electric charge, and adapted to supply the developer to the surface of the developer holding member through an opening formed at that site which faces a part of the endless moving path, and a charging member disposed at the downstream edge of the opening of the receptacle in the moving direction of the surface of the developer holding member, at least a part of said charging member being formed of an elastic material and said charging member having a free end adapted to be pressed against the surface of the developer holding member; characterized in that at least the tip portion of the charging member extends inclinedly at an angle $\beta$ of 0° to 90° to the normal of the surface of the developer holding member downstream in the moving direction of the surface of the developer holding member, the free end of the charging member is pressed against the surface of the developer holding member at a pressing force of 80 to 500 g/cm, and the thickness of a layer of the developer held on the surface of the developer holding member is adjusted to 10 to 50 microns by the action of the free end of the charging member.

31. The apparatus of claim 30 wherein the angle $\beta$ is 10° to 60° C.

32. The apparatus of claim 30 or 31 wherein the free end of the charging member is in the form of a sharp knife.

33. The apparatus of claim 30 or 31 wherein the pressing force is 100 to 300 g/cm.

34. The apparatus of claim 30 or 31 wherein the thickness of the developer layer is 25 to 35 microns.

35. The apparatus of claim 30 or 31 wherein a surface layer, at least 100 microns thick, of the developer holding member has a hardness of 15° to 60°.

36. The apparatus of claim 30 or 31 wherein a surface layer, at least 100 microns thick, of the developer holding member has a specific resistance of at least $10^{13}$ ohms-cm.

* * * * *